US011079179B2

(12) United States Patent
Wang et al.

(10) Patent No.: US 11,079,179 B2
(45) Date of Patent: Aug. 3, 2021

(54) SECOND-LEVEL LIQUID SLAG CACHE SYSTEM WITH FLOW AND TEMPERATURE MONITORING AND CONTROL FUNCTIONS

(71) Applicant: XI'AN JIAOTONG UNIVERSITY, Shaanxi (CN)

(72) Inventors: Shuzhong Wang, Shaanxi (CN); Zhongqing Zhang, Shaanxi (CN); Xi Zhang, Shaanxi (CN); Liwei Ma, Shaanxi (CN); Lin Chen, Shaanxi (CN); Haiyu Meng, Shaanxi (CN); Zefeng Jing, Shaanxi (CN); Jianjun Cai, Shaanxi (CN); Pengfei Yu, Shaanxi (CN)

(73) Assignee: XI'AN JIAOTONG UNIVERSITY, Shaanxi (CN)

( * ) Notice: Subject to any disclaimer, the term of this patent is extended or adjusted under 35 U.S.C. 154(b) by 331 days.

(21) Appl. No.: 16/318,085

(22) PCT Filed: Apr. 13, 2017

(86) PCT No.: PCT/CN2017/080328
§ 371 (c)(1),
(2) Date: Jan. 15, 2019

(87) PCT Pub. No.: WO2018/157452
PCT Pub. Date: Sep. 7, 2018

(65) Prior Publication Data

US 2020/0355437 A1 Nov. 12, 2020

(30) Foreign Application Priority Data

Feb. 28, 2017 (CN) ..... 201710114387.7

(51) Int. Cl.
*F27D 3/15* (2006.01)
*C21B 3/08* (2006.01)
*F27D 19/00* (2006.01)

(52) U.S. Cl.
CPC ..... *F27D 3/1536* (2013.01); *C21B 3/08* (2013.01); *F27D 19/00* (2013.01); *F27D 2019/0003* (2013.01)

(58) Field of Classification Search
CPC .... C21B 3/04; C21B 3/06; C21B 3/08; C21B 3/10; C21B 5/00; F27D 3/1536; F27D 19/00; F27D 2019/0003
See application file for complete search history.

(56) References Cited

U.S. PATENT DOCUMENTS 4,235,423 A * 11/1980 Kemlo ..... B22D 2/003 266/208
6,250,109 B1 * 6/2001 Hulek ..... C21B 3/08 65/19

(Continued)

*Primary Examiner* — Scott R Kastler

(57) ABSTRACT

A second-level liquid slag cache system with flow and temperature monitoring and control functions is disclosed. A slag inlet is located at an upper portion of the slag ladle casing; at least one slag discharging unit is located at a side of a lower portion of the slag ladle casing; one slag discharging unit is corresponding to one stopper; the stopper includes a stopper head, a stopper rod and a stopper control mechanism; the stopper control mechanism is configured to control the flow area between the stopper head and the sizing nozzle; a sealing cover is disposed outside the sizing nozzle; a slag control tube is installed at a bottom of the sealing cover. The present invention is able to achieve liquid slag buffer, flow control and heat compensation, so as to allow liquid slag to continuously stably perform a subsequent granulation process.

5 Claims, 2 Drawing Sheets

(56) References Cited

U.S. PATENT DOCUMENTS

2012/0073406 A1* 3/2012 Ki ..... C22B 7/04
75/414
2020/0355437 A1* 11/2020 Wang ..... F27D 3/15

* cited by examiner

SECOND-LEVEL LIQUID SLAG CACHE SYSTEM WITH FLOW AND TEMPERATURE MONITORING AND CONTROL FUNCTIONS

CROSS REFERENCE OF RELATED APPLICATION

This is a U.S. National Stage under 35 U.S.C 371 of the International Application PCT/CN2017/080328, filed Apr. 13, 2017, which claims priority under 35 U.S.C. 119(a-d) to CN 201710114387.7, filed Feb. 28, 2017.

BACKGROUND OF THE PRESENT INVENTION

Field of Invention

The present invention relates to the field of liquid slag waste heat recovery technology, and more particularly to a second-level liquid slag cache system with flow and temperature monitoring and control functions.

DESCRIPTION OF RELATED ARTS

China is currently the world's largest steel producer, and its steel output has remained the world's largest for 17 consecutive years. In 2014, China's pig iron production reached 711 million tons, accounting for about 60% of the world's total production; and simultaneously in the process of smelting pig iron, liquid slag containing huge heat was also produced. The discharge temperature of the liquid slag is generally between 1400 and 1550° C., and the sensible heat of per ton of slag is (1260 to 1880)×103 kJ which is equivalent to 60 kg of standard coal. Under the existing ironmaking technology in China, each ton of pig iron produced will produce 0.3 tons of liquid slag by-product. The current production of pig iron in China is 711 million tons, which can be converted into liquid slag of more than 213 million tons whose sensible heat is equivalent to 12.78 million tons standard coal.

The water slag method is the most common blast furnace slag treatment method in China. The water slag method releases a large amount of water vapor when the slag is cooled, and does not recover the high-quality waste heat resources contained in the blast furnace slag; at the same time, a large amount of $H_2S$ and $SO_2$ gas are released and discharged into the environment along with the water vapor, causing environmental problems such as acid rain, a lot of waste of water resources and extra energy consumption. These treatment methods have been unable to meet the urgent needs of energy conservation and emission reduction in the current steel industry. An efficient and non-polluting new technology must be sought to effectively recover blast furnace slag waste heat resources.

The rotating cup granulation technology is for recovering the high-temperature sensible heat of the slag. However, the flow control of the slag is a key part of the system. If the flow control of the slag is not good, the continuous stable performing of the subsequent granulation process will be affected.

SUMMARY OF THE PRESENT INVENTION

An object of the present invention is to provide a second-level liquid slag cache system with flow and temperature monitoring and control functions, which is able to achieve liquid slag buffer, flow control and heat compensation, so as to allow liquid slag to continuously stably perform a subsequent granulation process, and is able to be widely applied to a liquid slag granulation waste heat recovery system.

To achieve the above object, the present invention provides a technical solution as follows.

A second-level liquid slag cache system with flow and temperature monitoring and control functions, which comprises: a slag ladle casing, a stopper, a slag control tube and a sealing cover, wherein:

a slag inlet is located at an upper portion of the slag ladle casing; at least one slag discharging unit is located at a side of a lower portion of the slag ladle casing, and the at least one slag discharging unit comprises a seating brick and a sizing nozzle; one slag discharging unit is corresponding to one stopper; the stopper comprises a stopper head, a stopper rod and a stopper control mechanism; the seating brick has a brick channel and a sizing nozzle accommodating cavity communicated with the brick channel, and the sizing nozzle is disposed within the sizing nozzle accommodating cavity; one end of the brick channel is communicated with a chamber within the slag ladle casing for accommodating slag, and the other end of the brick channel is communicated with an inlet of a flow passage within the sizing nozzle; one end of the stopper rod is connected with the stopper head, and the other end of the stopper rod is connected with the stopper control mechanism; the stopper control mechanism is configured to control a flow area between the stopper head and the sizing nozzle; the sealing cover is disposed outside the sizing nozzle; the slag control tube is installed at a bottom of the sealing cover.

Preferably, at least one non-contact slag ladle liquid level monitoring device and at least one burner are located at a top of the slag ladle casing for monitoring a liquid level of liquid slag in a slag ladle and heat replenishment of the liquid slag in the slag ladle, respectively.

Preferably, a slag control tube liquid level detecting device and a non-contact temperature monitoring device are disposed at a top of the sealing cover; a side and the top of the sealing cover are openable; the sealing cover is in flange-sealed connection with the slag ladle casing.

Preferably, the sizing nozzle and the stopper head are made from a refractory material with corrosion resistance, the stopper rod is made from a high-temperature resistant metal material, and the stopper rod is in threaded connection with the stopper head.

Preferably, a layer of insulation material is coated on the slag control tube.

Preferably, the stopper is disposed outside the slag ladle, an angle between the stopper and a horizontal plane is in a range of 10 to 30 degrees, and the flow passage within the sizing nozzle is a non-equal cross-section flow passage whose cross section is firstly reduced and then enlarged; an angle between an upper portion of an inlet tapered section of the flow passage within the sizing nozzle and the horizontal plane is in a range of 100 to 110 degrees; an angle between an lower portion of the inlet tapered section of the flow passage within the sizing nozzle and the horizontal plane is in a range of 15 to 25 degrees; an outlet expansion section of the flow passage within the sizing nozzle is inverted conical; an angle between an upper portion of the outlet expansion section of the flow passage within the sizing nozzle and the horizontal plane is in a range of 15 to 25 degrees; and an angle between an lower portion of the outlet expansion section of the flow passage within the sizing nozzle and the horizontal plane is in a range of 5 to 15 degrees.

Preferably, when a flow of the slag exceeds a preset value, the stopper control mechanism goes forward to reduce the flow area between the stopper head and the flow passage within the sizing nozzle, so as to further reduce the flow of the slag; when the flow of the slag is lower than the preset value, the stopper control mechanism goes backward to enlarge the flow area between the stopper head and the flow passage within the sizing nozzle, so as to further increase the flow of the slag.

Preferably, the slag control tube is located at a side of the slag ladle casing.

Compared with the prior art, the present invention has some beneficial effects as follows.

The slag ladle casing provided by the present invention is able to achieve liquid slag buffer, flow control and heat compensation, so as to allow liquid slag to continuously stably perform a subsequent granulation process within the requirements, for realizing the granulation industrialization of liquid slag.

The stopper is disposed at the side of the slag ladle, the stopper head is in direct contact with the liquid slag to avoid the erosion of the stopper rod by the liquid slag for greatly prolonging the service life of the stopper. When the stopper head is eroded by the liquid slag, through adjusting the stopper control mechanism, the stopper head is inserted into the sizing nozzle for continuously maintaining the control of the flow of the liquid slag by the stopper, so as to prolong the service life of the stopper.

In the present invention, the flow of the liquid slag is controlled by changing the flow area between the stopper head and the sizing nozzle through the stopper control mechanism and adjusting the liquid level of the liquid slag in the slag control tube, which is able to greatly eliminate the large fluctuation of the flow caused by the change of the liquid level of the liquid slag in the slag ladle, so that the entire cache process is stable and meets the flow requirement of the subsequent granulation stage.

In the present invention, the slag control tube liquid level detecting device at the top of the sealing cover is configured to detect the liquid level of the liquid slag in the slag control tube; through the flow calculator, the instantaneous flow of the liquid slag in the slag control tube is calculated, which is associated with a rotational speed of a motor of the granulation system, so as to achieve the optimal granulation effect.

In the present invention, the non-contact temperature monitoring device at the top of the sealing cover is associated with the rotational speed of the motor of the granulation system and the burner at the top of the slag ladle casing; the replenishment heat power of the burner is adjusted in accordance with the temperature of the slag for ensuring that the temperature of the liquid slag meets system requirements and reducing the power consumption of replenishment heat; the rotational speed of the motor is adjusted in accordance with the temperature of the liquid slag, so as to achieve the optimal granulation effect.

In the present invention, the non-contact slag ladle liquid level monitoring device at the upper portion of the slag ladle casing is configured to give an alarm and timely close the slag inlet when the liquid level of the liquid slag reaches an alert level, so as to ensure the slag ladle has enough safe height to avoid accidents such as slag overflow, thereby improving operational safety.

In the present invention, the burner at the top of the slag ladle casing is configured to bake the slag ladle; when the temperature of the liquid slag is lower than an alert temperature, the burner is turned on to replenish heat for the liquid slag, so as to ensure the viscosity of the liquid slag in the slag ladle to avoid accidents such as solidified slag, thereby improving operational stability.

BRIEF DESCRIPTION OF THE DRAWINGS

The present invention is further described in detail with accompanying drawings and embodiments.

Figure 1:
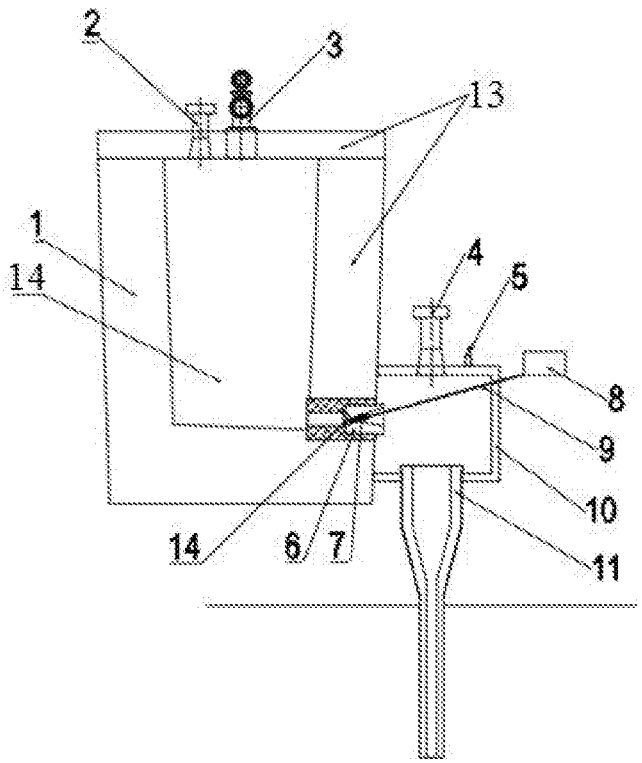
FIG. 1 is a structurally schematic view of a second-level liquid slag cache system with flow and temperature monitoring and control functions provided by the present invention.

In the drawings, reference signs are as follows:

1: slag ladle casing; 2: non-contact slag ladle liquid level monitoring device; 3: burner; 4: slag control tube liquid level detecting device; 5: non-contact temperature monitoring device; 6: sizing nozzle; 7: stopper head; 8: stopper control mechanism; 9: stopper rod; 10: sealing cover; 11: slag control tube; 12: slag inlet; 13: slag ladle; 14: chamber; 104: flow passage; 103: inlet of flow passage.

DETAILED DESCRIPTION OF THE PREFERRED EMBODIMENT

Figure 2:
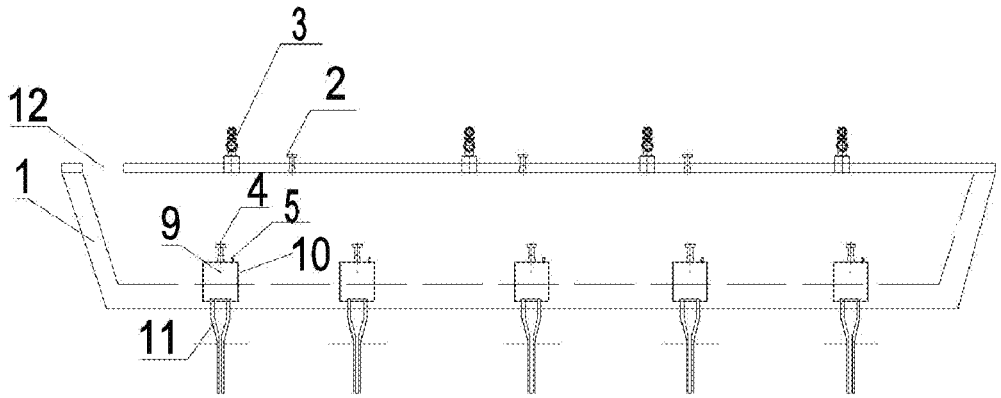
FIG. 2 is a right view of FIG. 1.
Figure 3:
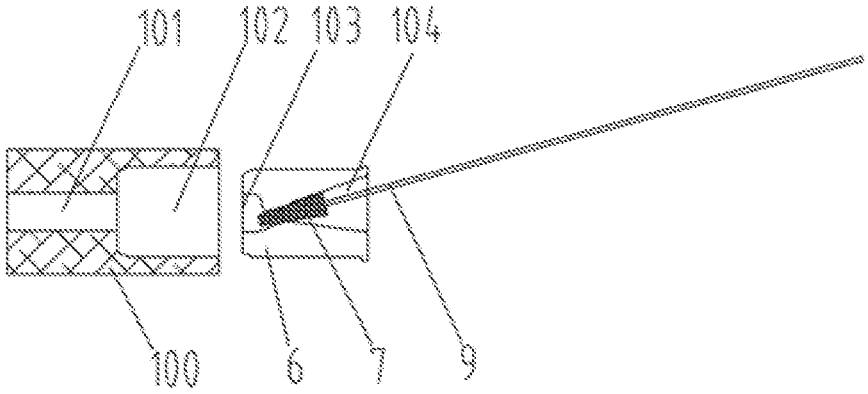
FIG. 3 is a partially enlarged view of a sizing nozzle.

Referring to FIGS. 1 to 3, a second-level liquid slag cache system with flow and temperature monitoring and control functions is illustrated, which comprises a slag ladle casing 1, a sizing nozzle 6, a stopper head 7, a stopper control mechanism 8, a slag control tube 11 and a sealing cover 10.

A slag inlet 12 is located at an upper portion of the slag ladle casing 1; at least one slag discharging unit is located at a bottom portion of the slag ladle casing 1, and the at least one slag discharging unit comprises a seating brick 100 and a sizing nozzle 6; one slag discharging unit is corresponding to one stopper; the stopper comprises a stopper head 7, a stopper rod 9 and a stopper control mechanism 8. The seating brick 100 has a brick channel 101 and a sizing nozzle accommodating cavity 102 communicated with the brick channel 101, and the sizing nozzle 6 is disposed within the sizing nozzle accommodating cavity 102. One end of the brick channel 101 is communicated with a chamber 14 within the slag ladle casing 1 for accommodating slag, and the other end of the brick channel 101 is communicated with an inlet 103 of a flow passage 104 within the sizing nozzle 6. One end of the stopper rod 9 is connected with the stopper head 7, the other end of the stopper rod 9 is connected with the stopper control mechanism 8. The stopper control mechanism 8 is configured to control a flow area between the stopper head 7 and the sizing nozzle 6. The sealing cover 10 is disposed outside a corresponding sizing nozzle 6. The slag control tube 11 is installed at a bottom of the sealing cover 10. The slag ladle casing 1 is made from a high-temperature refractory material composited with steel. Liquid slag flows from the slag inlet 12 which is located at an upper portion of a slag ladle and is temporarily stored in the slag ladle, and then the liquid slag flows into the slag control tube 11 from a side of the bottom portion of the slag ladle casing 1 via the sizing nozzle 6 through the sealing cover 10, and then flows into a granulation system which is disposed below the slag control tube.

The stopper is disposed outside the slag ladle, an angle between the stopper and a horizontal plane is in a range of 10 to 30 degrees, and the flow passage 104 within the sizing nozzle 6 is a non-equal cross-section flow passage whose cross section is firstly reduced and then enlarged. An angle between an upper portion of an inlet tapered section of the flow passage 104 within the sizing nozzle 6 and the horizontal plane is in a range of 100 to 110 degrees; and an angle between an lower portion of the inlet tapered section of the flow passage 104 within the sizing nozzle 6 and the horizontal plane is in a range of 15 to 25 degrees. An outlet expansion section of the flow passage 104 within the sizing nozzle 6 is inverted conical; an angle between an upper portion of the outlet expansion section of the flow passage 104 within the sizing nozzle 6 and the horizontal plane is in a range of 15 to 25 degrees; and an angle between an lower portion of the outlet expansion section of the flow passage 104 within the sizing nozzle 6 and the horizontal plane is in a range of 5 to 15 degrees. When the flow of the slag is too large, the stopper control mechanism 8 goes forward to reduce the flow area between the stopper head 7 and the flow passage 104 within the sizing nozzle 6, so as to further reduce the flow of the slag. When the flow of the slag is too small, the stopper control mechanism 8 goes backward to enlarge the flow area between the stopper head 7 and the flow passage 104 within the sizing nozzle 6, so as to further increase the flow of the slag. All of the seating brick 100, the sizing nozzle 6 and the stopper head 7 are made from a refractory material with high-temperature corrosion resistance; and the stopper rod 9 is made from a high-temperature resistant metal material.

When the stopper head 7 is eroded by the slag, through adjusting the stopper control mechanism 8, the stopper head 7 is inserted into the sizing nozzle 6 for continuously maintaining the control of the flow of the slag by the stopper, so as to prolong the service life of the stopper. When the sizing nozzle 6 and the stopper head 7 are severely corroded and cannot be used, the channel of the seating brick 100 is blocked by stemming, and the sizing nozzle 6 and the stopper head 7 are rapidly replaced, which has less impact on system operation.

A slag control tube liquid level detecting device 4 is installed at a top of the sealing cover 10 to detect a liquid level of the liquid slag in the slag control tube 11. Through a flow calculator, an instantaneous flow of the liquid slag is calculated and fed back to the stopper control mechanism 8. When the liquid level is too high, the stopper control mechanism 8 moves forwardly to reduce the flow area between the stopper head 7 and the sizing nozzle 6 for further reducing the flow of the liquid slag. The stopper head 7 is made from a special refractory material with high-temperature corrosion resistance, and the stopper rod 9 is made from a high-temperature resistant metal material.

A non-contact slag ladle liquid level monitoring device 2, which is located at the upper portion of the slag ladle casing 1, is configured to monitor the liquid level in the slag ladle in real time. Through the liquid level, the instantaneous liquid slag cache amount in the slag ladle is calculated to adjust the flow of the liquid slag; when the level of the liquid slag reaches an alert level, an alarm is given and the slag inlet 12 is timely closed, so as to ensure the slag ladle has enough safe height, to avoid accidents such as slag overflow.

A non-contact temperature monitoring device 5 is installed at a top of the sealing cover 10, and a burner 3 is installed at a top of the slag ladle casing 1. The temperature of the liquid slag in the slag control tube 11 is monitored and fed back to the burner 3 for controlling an ON/OFF and replenishment heat power of the burner 3; and the instantaneous temperature of the liquid slag is fed back to the granulation system to timely adjust a rotational speed of a motor. A layer of insulation material is coated on the sealing cover 10 and the slag control tube 11 to reduce heat dissipation for ensuring the temperature of the liquid slag.

The slag of the slag cache system provided by the present invention is discharged from a side of the slag ladle instead of a bottom thereof; the sizing nozzle 6 is cooperated with the stopper head 7 at the slag discharging unit to control the flow of the slag; the slag control tube 11 is disposed at the side of the slag ladle casing 1 instead of the bottom thereof; the slag ladle casing 1 is connected with the slag control tube 11 through the sealing cover 10, so that the flow of the slag is easy to be controlled, the sizing nozzle 6 and the slag control tube 11 are easily maintained and replaced, thus the disadvantages of the prior art that the slag is discharged from the bottom of the slag ladle and the slag control tube is difficult to be replaced and maintained are avoided, and the continuity and stability of the system is enhanced.

Finally, it should be noted that the above embodiments are only for illustrating the present invention and are not intended to limit the technical solution described in the present invention. Therefore, although the present specification has been described in detail with reference to various embodiments described above, it will be understood by those skilled in the art that the present invention may be modified or equivalently substituted. And all the technical solutions and improvements without departing from the spirit and scope of the present invention should be included in the scope of the claims of the present invention.

What is claimed is:

1. A second-level liquid slag cache system, which comprises: a slag ladle casing (1), a stopper, a slag control tube (11) and a sealing cover (10), wherein:

a slag inlet (12) is located at an upper portion of the slag ladle casing (1), at least one slag discharging unit is located at a side of a lower portion of the slag ladle casing (1), the at least one slag discharging unit comprises a seating brick (100) and a sizing nozzle (6);

the stopper comprises a stopper head (7), a stopper rod (9) and a stopper control mechanism (8);

the seating brick (100) has a brick channel (101) and a sizing nozzle accommodating cavity (102) communicated with the brick channel (101), the sizing nozzle (6) is disposed within the sizing nozzle accommodating cavity (102), the slag ladle casing (1) has a chamber for accommodating slag, one end of the brick channel (101) is communicated with the chamber, the other end of the brick channel (101) is communicated with an inlet of a flow passage within the sizing nozzle (6);

one end of the stopper rod (9) is connected with the stopper head (7), the other end of the stopper rod (9) is connected with the stopper control mechanism (8), the stopper control mechanism (8) is configured to control a flow area between the stopper head (7) and the sizing nozzle (6), the sealing cover (10) is disposed outside the sizing nozzle (6), the slag control tube (11) is installed at a bottom of the sealing cover (10);

the stopper is disposed outside the slag ladle casing, an angle between the stopper and a horizontal plane is in a range of 10 to 30 degrees, and the flow passage within the sizing nozzle (6) is a non-equal cross-section flow passage whose cross section is firstly reduced and then enlarged; an angle between an upper portion of an inlet tapered section of the flow passage within the sizing nozzle (6) and the horizontal plane is in a range of 100 to 110 degrees; an angle between a lower portion of the inlet tapered section of the flow passage within the sizing nozzle (6) and the horizontal plane is in a range of 15 to 25 degrees; an outlet expansion section of the flow passage within the sizing nozzle (6) is inverted conical; an angle between an upper portion of the outlet expansion section of the flow passage within the sizing nozzle (6) and the horizontal plane is in a range of 15 to 25 degrees; and an angle between a lower portion of the outlet expansion section of the flow passage within the sizing nozzle (6) and the horizontal plane is in a range of 5 to 15 degrees.

2. The second-level liquid slag cache system according to claim 1, wherein at least one non-contact slag ladle liquid level monitoring device (2) and at least one burner (3) are located at a top of the slag ladle casing (1) for monitoring a liquid level of liquid slag in a slag ladle and heat replenishment of the liquid slag in the slag ladle, respectively.

3. The second-level liquid slag cache system according to claim 1, wherein a slag control tube liquid level detecting device (4) and a non-contact temperature monitoring device (5) are disposed at a top of the sealing cover (10); a side and the top of the sealing cover (10) are openable; the sealing cover (10) is in flange-sealed connection with the slag ladle casing (1).

4. The second-level liquid slag cache system according to claim 1, wherein the sizing nozzle (6) and the stopper head (7) are made from a refractory material with corrosion resistance, the stopper rod (9) is made from a high-temperature resistant metal material, the stopper rod (9) is in threaded connection with the stopper head (7).

5. The second-level liquid slag cache system according to claim 1, wherein a layer of insulation material is coated on the slag control tube (11).

* * * * *